US011729563B2

(12) United States Patent
Berthelsen et al.

(10) Patent No.: US 11,729,563 B2
(45) Date of Patent: Aug. 15, 2023

(54) BINAURAL HEARING DEVICE WITH NOISE REDUCTION IN VOICE DURING A CALL

(71) Applicant: GN Hearing A/S, Ballerup (DK)

(72) Inventors: Kim Spetzler Berthelsen, Ballerup (DK); Johnny Fredsgaard, Ballerup (DK); Niels Oddershede, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/589,685

(22) Filed: Jan. 31, 2022

(65) Prior Publication Data

US 2022/0256299 A1 Aug. 11, 2022

(30) Foreign Application Priority Data

Feb. 9, 2021 (DK) ..... PA 2021 70058
Feb. 9, 2021 (EP) ..... 21156020

(51) Int. Cl.
*H04R 25/00* (2006.01)

(52) U.S. Cl.
CPC ..... *H04R 25/70* (2013.01); *H04R 25/554* (2013.01); *H04R 2225/41* (2013.01); *H04R 2225/51* (2013.01)

(58) Field of Classification Search
CPC .. H04R 25/70; H04R 25/554; H04R 2225/41; H04R 2225/51; H04R 3/005; H04R 2201/107; H04R 2420/07
See application file for complete search history.

(56) References Cited

U.S. PATENT DOCUMENTS 9,401,158 B1 7/2016 Yen
9,877,116 B2 * 1/2018 Udesen ..... H04R 25/552
(Continued)

FOREIGN PATENT DOCUMENTS

EP 3116239 1/2017
EP 3627848 3/2020
(Continued)

OTHER PUBLICATIONS

2nd Examination Report for Danish Patent Appln. No. PA 2021 70058 dated Mar. 28, 2022.
(Continued)

*Primary Examiner* — Brian Ensey
(74) *Attorney, Agent, or Firm* — Vista IP Law Group, LLP

(57) ABSTRACT

A hearing device system includes: first and second hearing devices, each of which comprising at least one microphone, a primary antenna, and a speaker; the hearing device system configured to communicate with an electronic device configured to establish a call between the user and a far-end person; the hearing device system configured to determine a first noise level, $N_1$, of sound received by the at least one microphone of the first hearing device, and a second noise level, $N_2$, of sound received by the at least one microphone of the second hearing device; the hearing device system configured to transmit a voice signal to the electronic device, the voice signal being based on a voice of the user captured by the at least one microphone of the first hearing device when $N_1<N_2$, or captured by the at least one microphone of the second hearing device when $N_1>N_2$.

22 Claims, 3 Drawing Sheets

(56) References Cited

U.S. PATENT DOCUMENTS

| | | | | |
|---|---|---|---|---|
| 2007/0009127 | A1 | 1/2007 | Klemenz et al. | |
| 2008/0175399 | A1 | 7/2008 | Kim et al. | |
| 2015/0245129 | A1* | 8/2015 | Dusan | G10L 21/0208 381/71.6 |
| 2016/0134956 | A1 | 5/2016 | Tan et al. | |
| 2018/0174597 | A1 | 6/2018 | Lee et al. | |
| 2018/0234777 | A1* | 8/2018 | Roeck | G10L 19/22 |
| 2020/0029160 | A1 | 1/2020 | El-hoiydi | |

FOREIGN PATENT DOCUMENTS

| | | |
|---|---|---|
| EP | 3253035 | 12/2020 |
| WO | WO 2014/048492 | 4/2014 |

OTHER PUBLICATIONS

Examination Report dated Aug. 31, 2021 for Danish patent application No. PA 2021 70058.
Extended European search report dated Oct. 26, 2021 for European patent application No. 21156020.6.

* cited by examiner

BINAURAL HEARING DEVICE WITH NOISE REDUCTION IN VOICE DURING A CALL

RELATED APPLICATION DATA

This application claims priority to, and the benefit of, Danish Patent Application No. PA 2021 70058 filed on Feb. 9, 2021, and European Patent Application No. 21156020.6 filed on Feb. 9, 2021. The entire disclosures of the above applications are expressly incorporated by reference herein.

FIELD

The present disclosure relates to a hearing device system configured to operate in a call mode.

BACKGROUND

A hearing system user performing a phone call may be in various environments and sometimes it may be difficult for the user to change the environment. For instance, the user may be in a car, and naturally, noise coming from the outside will be stronger on the side where widows close to the user are. This noise can, together with the user's voice, be communicated to a far-end caller and the far-end caller may have difficulties distinguishing the user's voice from noise. Also, the user may not be able to hear the far-end caller properly, due to present noise. It is desired that the hearing device system can recognize such scenario and perform the call in accordance to the present sound environment.

There is a need for a hearing device system which can improve the sound quality during a call.

SUMMARY

It is an object of embodiments to provide a hearing device system with improved sound quality during a call.

It is a further object of the embodiments to provide a hearing device system which provides the best sound quality for the user of the system.

It is also an object of the embodiment to provide a hearing device system which provides improved sound quality for a far-end caller.

In a first aspect, disclosed is a hearing device system comprising a first hearing device and a second hearing device. The first and second hearing device are configured to be worn at a first ear and second ear, respectively, of a user. The first hearing device and the second hearing device each comprise at least one microphone, a primary antenna configured for establishing a first bidirectional wireless link with the other hearing device, and a speaker. At least one of the first and second hearing devices comprises a secondary antenna configured for establishing a second bidirectional wireless link with an electronic device. The electronic device is adapted for establishing a call between the user of the hearing device system and a far-end caller. The hearing device system is configured to determine a first noise level, N1, of sound received by the at least one microphone of the first hearing device. The hearing device system is also configured to determine a second noise level, N2, of sound received by the at least one microphone of the second hearing device. Further, the hearing device system is configured to operate in a call mode. When, during the call, the first noise level is smaller than the second noise level, N1<N2, the at least one microphone of the first hearing device is selected to capture the user's voice for the call. When, during the call, the second noise level is smaller than the first noise level, N1>N2, the at least one microphone of the second hearing device is selected to capture the user's voice for the call.

In the present context, the hearing device system can be directed to a headset, a binaural hearing system, or binaural hearing aids.

The first hearing device and a second hearing device may have a number of the same components and their function in general may be the same, i.e. to provide an audio signal to the user, as well as to communicate the user's voice to another device. The first hearing device is configured to be worn on one user's ear, e.g. right, and the second hearing device is configured to be worn another, e.g. left, user's ear. However, in some embodiments, the first and second device may be symmetrical so that they can be used interchangeably on both ears.

The first hearing device and the second hearing device each comprise at least one microphone. The microphones are configured for reception of sounds from the environment including the user's voice. The number of microphones on the first and second device may be the same as well as their position in or on the hearing devices.

Each hearing device also comprise a speaker configured to provide an audio signal to the user. The audio signal may be generated in response to sounds from the environment, it may represent signals received from an external device, such as music, a voice from an ongoing call, or similar. Alternatively, instead of a speaker one or both hearing devices may comprise a cochlear implant.

Further, each hearing device comprises a primary antenna for establishing communication between the first and second hearing device. The primary antenna may be a magnetic antenna. In that case, the bidirectional communication link established between the devices is a magnetic induction (MI) link. The first bidirectional link typically serves for exchanging various information and settings between the two hearing devices. The first bidirectional link may also serve for sending audio signal from one hearing device to another. For instance, the first hearing device may, as per system settings, be the only one receiving sounds from environment and/or from an external device. Then a first primary antenna may communicate a corresponding audio signal to a second primary antenna of the second is device so that the user hears the signal in both hearing devices.

At least one of the first and second hearing devices comprises a secondary antenna for establishing a second bidirectional link with an electronic device. The secondary antenna can be an electric antenna, a Bluetooth antenna, or a magnetic antenna. The hearing device comprising the secondary antenna typically also comprises a wireless communication unit configured for wireless communication and interconnected with the secondary antenna. The primary antenna may also be connected to the wireless communication unit. The secondary antenna may also receive and send signals to more than one external electronic device. The secondary antenna may be arranged only on/in the first hearing device.

The electronic device can be a smart phone, computer, laptop, tablet, a smart watch, or other wearables, etc., and in general a device which can perform a call, via, e.g., a telephone network, IP network, or other. The electronic device may also be a bridge device, e.g. a Bluetooth bridge, that is a device serving as an intermediary device between the hearing device system and a further device performing the call. The secondary antenna may ensure pairing between the hearing device system and electronic device. The second bidirectional wireless link may serve for exchanging various information and settings between the hearing devices and the electronic device. The electronic device is adapted for establishing a call between the user of the hearing device system and a far-end caller. The electronic device may establish the connection with the hearing device upon call initialization and the connection may remain during the call. Alternatively, the electronic device may be in a constant connection with the hearing device regardless of the call. The call can be a voice call, e.g. only audio, or a video call, e.g. both audio and video.

The user of the hearing device system may initiate the call and he/she can also respond to a call either through the electronic device or via one of the hearing devices. When the electronic device receives the call, the call may be communicated to the hearing device system automatically as it is configured to operate in a call mode. Also, if the user of the hearing device system wants to make a call, he/she may select the hearing system to perform the call instead of the electronic device.

The hearing device system is configured to determine noise from the user's environment. The noise may be determined by a processing unit. The first and second hearing device may both comprise a processing unit. In some embodiments, at least one of the hearing devices may comprise the processing unit. The processing unit may be connected to the microphones thereby receiving signals detected by the microphones. The processing unit may then determine the first and second noise levels. In some embodiments, the hearing device system may be configured to measure and determine noise levels at least when the electronic device is performing the call between the user and a far-end caller. Additionally, the hearing device system may be configured to measure noise all the time while in use, and use measurements obtained before the call is initiated to start the call with optimal settings. Sound received by the microphones of the first and second hearing device can contain sounds from various sources in the user's environment, e.g. people talking, traffic noise, music in the room, etc. The hearing device system may measure a signal-to-noise ratio of the overall sound received by the microphones. Sound received by the microphone(s) of the first hearing device may be different from the sound received by the microphone (s) of the second hearing device simply because the user's head may be a shield for some sounds coming from one particular side of the user's head. The processing unit may be configured to compare the first and second noise level, $N_1$ and $N_2$, and based on the comparison operate the hearing system accordingly.

When, during the call, the first noise level is smaller than the second noise level, $N_1<N_2$, the at least one microphone of the first hearing device is selected to capture the user's voice for the call. In this case, the microphone(s) of the second hearing device may be disabled, or the sound captured by the microphone(s) may not be transmitted/used, and only the first hearing device microphone(s) would serve for sound reception. A signal stemming from the user's captured voice will then be transmitted to the electronic device through the first hearing device via the second bidirectional wireless link.

When, during the call, the second noise level is smaller than the first noise level, $N_2<N_1$, the at least one microphone of the second hearing device is selected to capture the user's voice for the call. In this case, the microphone(s) of the first hearing device may be disabled or the sound captured by the microphone(s) may not be transmitted/used. Namely, the user's voice in the call will be captured by the microphone of the hearing device exposed to a lower noise level. The processing unit may be the one controlling activation of the microphone with the lowest noise level and its use during the call. A signal stemming from the user's captured voice will at first be transmitted from the second hearing device to the first hearing device through the first bidirectional wireless link and then from the first hearing device through the second bidirectional wireless link the signal will be transmitted to the electronic device.

The electronic device may be connected to only one hearing device. If the electronic device is connected to the hearing device exposed to a higher noise, the call will continue on the other hearing device, i.e. the call will be transferred to the less noisy device. If the electronic device is connected to a less noisy hearing device, the call will continue on the same hearing device. In some scenarios, the processing unit may, based on measured noise before the call is initiated, connect to a less noisy device upon the call initiation. Namely, the audio signal from the far-end caller may be received on the hearing device exposed to lower noise. Alternatively, the audio signal from the far-end caller may be received on both hearing devices. In some embodiments, the hearing device system may have a dynamic volume control. Namely, the processing unit may further be configured to turn up the volume of the speaker of the first or second hearing device having the lowest noise level of the first and second noise level.

When the electronic device is connected to only one hearing device, e.g. the first hearing device, this hearing device will analyse signals from the second hearing device streamed through the first bidirectional wireless link. The first hearing device will also perform noise level determination and comparison.

In some embodiments, the hearing device system can determine frequency of the noise at each of the hearing devices. If the frequency or a frequency band of the noise at the two hearing devices differ significantly from each other, the hearing device system may combine sound from the microphones of both hearing devices and use the combination to provide it to the far-end caller.

The hearing device system of the present disclosure ensures that the far-end caller always gets the best sound quality. The hearing device system of the present disclosure allows for management of sounds from the user's environment such that the far-end caller receives the user's voice with minimum external noise.

The first and/or the second hearing device may be a headset, a hearing aid, a hearable etc. The hearing device may be an in-the-ear (ITE) hearing device, a receiver-in-ear (RIE) hearing device, a receiver-in-canal (RIC) hearing device, a microphone-and-receiver-in-ear (MaRIE) hearing device, a behind-the-ear (BTE) hearing device, an over-the-counter (OTC) hearing device etc, a one-size-fits-all hearing device etc.

The hearing device is configured to be worn by a user. The hearing device may be arranged at the user's ear, on the user's ear, in the user's ear, in the user's ear canal, behind the user's ear etc. The user may wear two hearing devices, one hearing device at each ear. The two hearing devices may be connected, such as wirelessly connected.

The hearing device may be configured for audio communication, e.g. enabling the user to listen to media, such as music or radio, and/or enabling the user to perform phone calls. The hearing device may be configured for performing hearing compensation for the user. The hearing device may be configured for performing noise cancellation etc.

The hearing device may be any hearing device, such as any hearing device compensating a hearing loss of a wearer of the hearing device, or such as any hearing device providing sound to a wearer, or such as a hearing device providing noise cancellation, or such as a hearing device providing tinnitus reduction/masking. The person skilled in the art is well aware of different kinds of hearing devices and of different options for arranging the hearing device in and/or at the ear of the hearing device wearer.

For example, the hearing device may be a Receiver-In-Canal (RIC) or Receiver-In-the-Ear (RIE or RITE) or a Microphone-and-Receiver-In-the-Ear (MaRIE) type hearing device, in which a receiver is positioned in the ear, such as in the ear canal, of a wearer during use, for example as part of an in-the-ear unit, while other hearing device components, such as a processor, a wireless communication unit, a battery, etc. are provided as an assembly and mounted in a housing of a Behind-The-Ear (BTE) unit. A plug and socket connector may connect the BTE unit and the earpiece, e.g. RIE unit or MaRIE unit.

The hearing device comprises a first input transducer, e.g. a microphone, to generate one or more microphone output signals based on a received audio signal. The audio signal may be an analogue signal. The microphone output signal may be a digital signal. Thus, the first input transducer, e.g. microphone, or an analogue-to-digital converter, may convert the analogue audio signal into a digital microphone output signal. All the signals may be sound signals or signals comprising information about sound. The hearing device may comprise a signal processor. The one or more microphone output signals may be provided to the signal processor for processing the one or more microphone output signals. The signals may be processed such as to compensate for a user's hearing loss or hearing impairment. The signal processor may provide a modified signal. All these components may be comprised in a housing of the BTE unit. The hearing device may comprise a receiver or output transducer or speaker or loudspeaker. The receiver may be connected to an output of the signal processor. The receiver may output the modified signal into the user's ear. The receiver, or a digital-to-analogue converter, may convert the modified signal, which is a digital signal, from the processor to an analogue signal. The receiver may be comprised in the earpiece, e.g. RIE unit or MaRIE unit. The hearing device may comprise more than one microphone, and the BTE unit may comprise at least one microphone and the RIE unit may also comprise at least one microphone.

The hearing device signal processor may comprise elements such as an amplifier, a compressor and/or a noise reduction system etc. The signal processor may be implemented in a signal-processing chip or a printed circuit board (PCB). The hearing device may further have a filter function, such as compensation filter for optimizing the output signal.

The hearing device may furthermore comprise a wireless communication unit or chip, such as a wireless communication circuit or a magnetic induction chip, for wireless data communication interconnected with an antenna, such as an radio frequency (RF) antenna or a magnetic induction antenna, for emission and reception of an electromagnetic field. The wireless communication unit including a radio or a transceiver, may connect to the hearing device signal processor and the antenna, for communicating with one or more external devices, such as one or more external electronic devices, including at least one smart phone, at least one tablet, at least one hearing accessory device, including at least one spouse microphone, remote control, audio testing device, etc., or, in some embodiments, with another hearing device, such as another hearing device located at another ear, typically in a binaural hearing device system.

In some embodiments, each of the first and the second hearing devices may comprise a noise detection unit. The noise detection units may be configured to perform determination of noise levels $N_1$ and $N_2$. In some embodiments, the processing unit may comprise the noise detection unit. In some embodiments, the processor unit may be connected to the noise detection unit. The noise detection unit may send determined noise levels to the processing unit. The noise detection unit of the hearing device which may not have the processing unit may communicate noise levels via the MI link to the hearing device with the processing unit. A separate noise detection unit ensures quick and accurate determination of the noise levels. Also, when each hearing device comprises its own noise detection unit, noise measurement are in accordance to how the user experiences the environment and how the sounds from the environment would be communicated to the far-end caller if there was no sound management during the call.

In some embodiments, at least one of the first and second hearing devices may comprise a speech detector. The speech detector may be configured to identify other people talking in a close proximity to the user. The speech detector may be connected to the processing unit and its input may contribute to determination of the noise levels $N_1$ and $N_2$.

In some embodiments, the noise detection unit may comprise an uncorrelated noise detector. Uncorrelated noise is individual for each microphone of the hearing devices as it is generated close to the microphone caused by wind or movement turbulence. The uncorrelated noise detector may determine turbulences around the user's ears originating from movements of the user, when the user runs or cycles or walks, or turbulences caused by wind. The uncorrelated noise detector may comprise a wind detector. The wind detector may determine turbulences around the user's ear caused by wind which normally comprises low frequencies. Wind noise being predominant in the frequency band of 22 Hz to 5 kHz. The wind noise detector may therefore comprise a low pass filter to allow detection of only low frequency wind noise while blocking other frequencies which are not of interest for the wind noise detector. For correlated noise, such as traffic noise, another detector may be arranged at each of the first and second hearing devices.

In some embodiments, the first and the second hearing devices may be configured to be placed in the left and right ear, respectively, of the user. The hearing devices may therefore be earbuds.

In some embodiments, the first and second hearing devices may be hearing aids configured to compensate for a hearing loss of the user. In this embodiment, the hearing device system is a binaural hearing aid. The processing unit may be configured to compensate for a hearing deficit of the user. The processing unit may then have multiple functions, and perform them simultaneously, such as performing the comparison of noise levels, controlling microphones for use in the call, and compensate for the hearing deficit. It is an advantage to have a binaural hearing aid configured for performing a call and at the same time ensure good sound quality of the call both at the user's end and at the far-end caller's end.

In some embodiments, the at least one microphone of the hearing device establishing the second bidirectional wireless link may be configured to capture the user's voice upon a start of the call. Then the processing unit may, based on the determined noise levels, switch to the microphone(s) of the other hearing device if the sound quality is better on the other side of the user's hear. By having only one secondary antenna in the system, the hearing device system is simplified. In embodiments where both hearing devices comprise the secondary antenna, the electronic device may connect randomly to the first or second device. Alternatively, the processing unit of the hearing devices may influence call initiation. In some embodiments, wherein the at least one microphone of the hearing device which first establishes the wireless communication with the electronic device may be configured to pick up the user's voice upon a start of the phone call.

If at any point the determined noise levels change and the switch to another device may need to be performed, the switch may be performed by switching to the bidirectional wireless link established between the other hearing device and the electronic device. If the other hearing device does not comprise the secondary antenna for establishing the link with the electronic device, the switch can occur through the MI link established between the two hearing devices. In this scenario, the audio signal picked by the less noisy microphone(s) will be communicated through the MI link to the other device connected to the electronic device.

In some embodiments, the switch may be performed after a predetermined time. Namely, there may be some idle time when switching is not performed even though it is determined that the microphone(s) of the other device, which are not currently used, are less exposed to lower level of noise. By performing switching only after a predetermined time, it is possible to avoid possible frequent switching in scenarios when the environment changes frequently or when the user is in motion, running, cycling, etc. Alternatively, it is possible to perform a slow switching, i.e. fading the voice from the microphone of one hearing device to the microphone of the other hearing device.

In some embodiments, the first and second hearing devices may each comprise at least two microphones and a beamformer. When in the call mode and when $N_1$ is lower than $N_2$, $N_1<N_2$, the hearing device system may further be configured to beamform signals from the at least two microphones of the first hearing device. Also, when $N_2$ is lower than $N_1$, $N_1>N_2$, the hearing device system may be configured to beamform signals from the at least two microphones of the second hearing device. The beamforming may improve directionality of sound and serves to remove noise from signal to be sent to the far-end caller. A low pass filter may be arranged after the beamformer in order to further remove high frequency sounds from the environment, such as high frequency sirens.

In some embodiments, when in the call mode and when $N_1<N_2$, the hearing device system may further be configured to set a volume setting of the speaker of the second hearing device higher than a volume setting of the speaker of the first hearing device, and when $N_1>N_2$, set the volume setting of the speaker of the second hearing device lower than the volume setting of the speaker of the first hearing device. The processing unit may automatically set such settings upon determination and comparison of the noise levels. In this way, the user will have a higher sound volume at the hearing device on the side of the head which is exposed to a higher noise level compared to the other side. Thereby, it is not only the far-end caller experiencing the best sound quality but it is also the user of the system whose sound experience will be improved. The volume settings may be streamed through the first wireless bidirectional link between the hearing devices. If the processing unit is arranged only in the hearing device with the lower noise level, that processing unit may control volume in the other hearing device via the first bidirectional link.

In some embodiment, the first and second hearing device may both comprise a noise cancellation unit. The noise cancellation unit may ensure that, when the system is in the call mode, noise is canceled on the hearing device exposed to a higher noise level. It is an advantage to have a system in which noise is canceled in accordance to the detected noise levels $N_1$ and $N_2$. This also improves the user's experience during the call.

In some embodiments, each hearing device may comprise an active acoustic vent. When in the call mode and when $N_1<N_2$, the hearing device system may further be configured to open the acoustic vent of the first hearing device more than the acoustic vent of the second hearing device, and when $N_1>N_2$, open the acoustic vent of the second hearing device more than the acoustic vent of the first hearing device. Active vents normally comprise a passage between the inside of the ear, i.e. behind the hearing device, and the outside environment, and a valve for regulating the fluid connection through the passage. A closed setting allows less ambient noise and higher sound pressure. An open setting allows fluid connection, thus giving the user better ambient awareness.

In some embodiments, the hearing device may be configured to split the signals captured by the one or more microphones of the first and second hearing devices into several frequency bands, FB, i.e. $FB_{1,1}$, $FB_{1,2}$, $FB_{1,3}$, . . . $FB_{1,N}$, for the first hearing device and $FB_{2,1}$, $FB_{2,2}$, $FB_{2,3}$, . . . $FB_{2,N}$ for the second hearing device. The hearing device system may perform noise detection for each frequency band. The hearing device system may be configured to create the signal for the call by combing the respective frequency bands that have the lower noise. Thus, the audio from the user's side may have better quality in situations where one of the hearing aids is affected by noise in some frequency bands, e.g. lower frequency bands, and the other hearing device is affected by noise in other frequency bands, e.g. higher frequency bands.

In some embodiments, the hearing device system may be configured to analyse the frequency of noise of the sound received by the at least one microphone of the first hearing device and of the sound received by the at least one microphone of the second hearing device. The hearing device system may be configured to combine the user's voice from the microphones of the first and second hearing devices if the noise on the at least one microphone of the first hearing device comprises a frequency band different than noise on the at least one microphone of the second hearing device. Namely, the sound spectrum originating from the user and the environment can be split into bands and each band can be analyzed for noise. The various frequency bands with less noise can then be combined and in particular bands which encompass the human voice. The human voice is usually in the frequency range between 300 and 3000 Hz.

In a second aspect, a method for operating a hearing device system is disclosed. The hearing device system comprises a first hearing device and a second hearing device configured to be worn at a first ear and second ear, respectively, of a user. The first hearing device and the second hearing device each comprise at least one microphone, a primary antenna for establishing a first bidirectional wireless link with the other hearing device, and a speaker. At least one of the first and second hearing devices comprises a secondary antenna for establishing a second bidirectional wireless link with an electronic device adapted for establishing a call between the user and a far-end caller. The method comprises the step of initiating the call between a user and a far-end caller. The method further comprises the step of determining a first noise level, $N_1$, of sound received by the at least one microphone of the first hearing device and a second noise level, $N_2$, of sound received by the at least one microphone of the second hearing device. Further, when $N_1<N_2$, the at least one microphone of the first hearing device is selected to capture the user's voice for the call. When $N_1>N_2$, the at least one microphone of the second hearing device is selected to capture the user's voice for the call.

The call is initiated by establishing a wireless connection between the electronic device and at least one of the first and second hearing device which comprises the secondary antenna and typically further comprises a wireless communication unit. The electronic device may be seen as a master device controlling which hearing device to connect to.

Noise levels determination may be performed all times, regardless of whether the call is in progress or not. When the noise levels are measured and the call is initiated, the hearing device system, i.e. a processor unit of at least one hearing device, may compare the first and second noise levels determined by, e.g., a noise detection unit, and based on the comparison, make a decision on how to proceed with the call, i.e. which hearing device is to be used for continuing the call.

The present disclosure relates to different aspects including the system described above and in the following, and a corresponding method yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
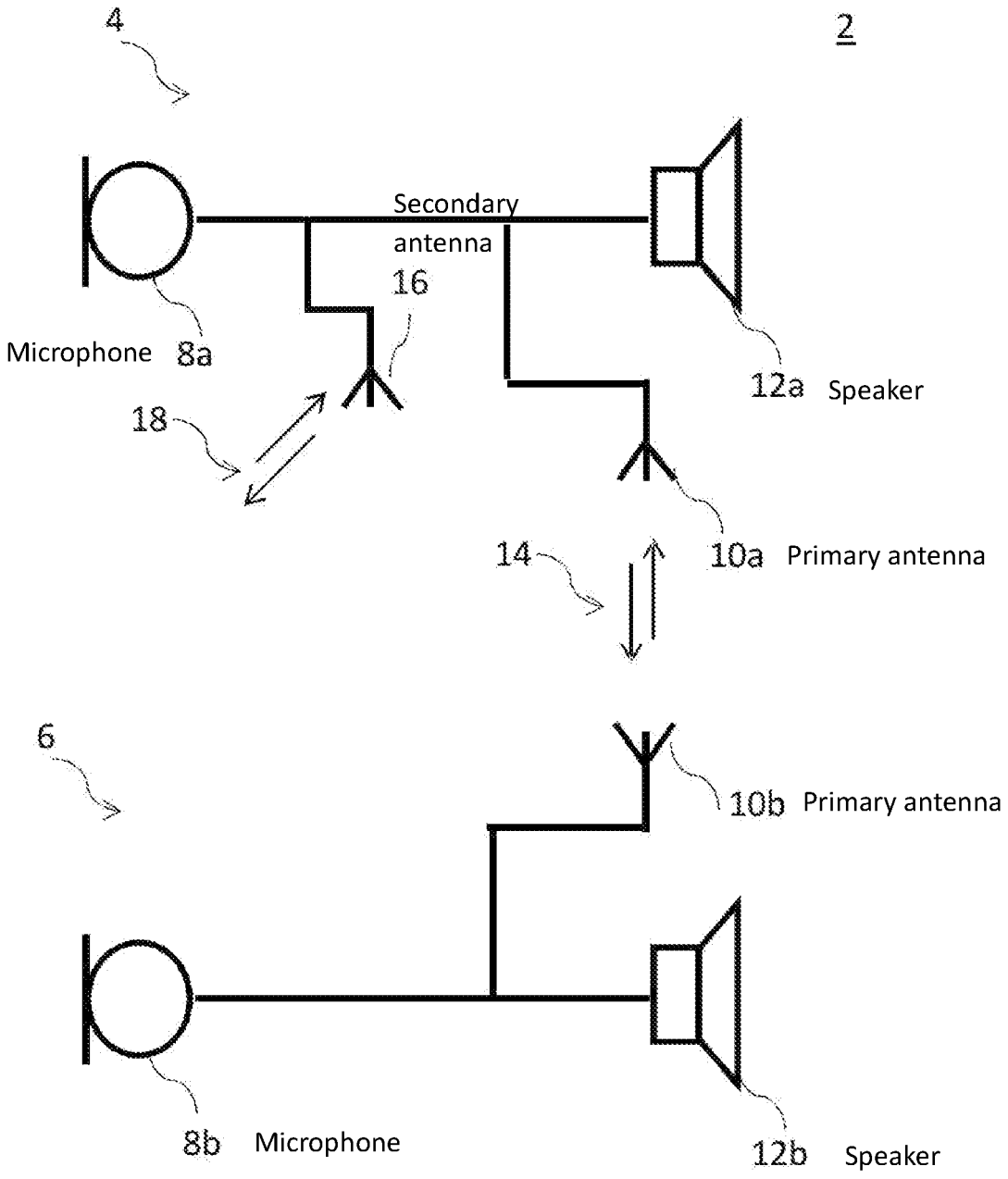
FIG. 1 schematically illustrates an example of a hearing device system comprising a first hearing device and a second hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates an example of a hearing device system 2. The system comprises a first hearing device 4 and a second hearing device 6. The first hearing device 4 and the second hearing device 6 are configured to be worn at a first ear and second ear, respectively, of a user. The first hearing device 4 comprises at least one microphone 8*a*, a primary antenna 10*a*, and a speaker 12*a*. Similarly, the second hearing device 6 comprises at least one microphone 8*b*, a primary antenna 10*b*, and a speaker 12*b*. The primary antennas 10*a*, 10*b* are configured for establishing a first bidirectional wireless link 14 between the first hearing device 4 and the second hearing device 6.

The first hearing device 4 further comprises a secondary antenna 16 configured for establishing a second bidirectional wireless link 18 with an electronic device (not shown). Alternatively, the second hearing device may comprise the secondary antenna 16. The electronic device is adapted for establishing a call between the user and a far-end caller.

The hearing device system 2 is configured to determine a first noise level, $N_1$, of sound received by the at least one microphone 8*a* of the first hearing device 4 and a second noise level, $N_2$, of sound received by the at least one microphone 8*b* of the second hearing device 6.

The hearing device system 2 is further configured to operate in a call mode. When the first noise level is lower than the second noise level, $N_1<N_2$, the at least one microphone 8*a* of the first hearing device 4 is selected to capture the user's voice for the call. When the second noise level is lower than the first noise level, $N_1>N_2$, the at least one microphone 8*b* of the second hearing device 6 is selected to capture the user's voice for the call.

By selecting a less noisy microphone, a less noisy side of the user is selected and the hearing device system 2 thereby ensures that the far-end caller always gets the best sound quality. The hearing device system 2 allows for management of sounds from the user's environment such that the far-end caller receives the user's voice with minimum external noise.

The hearing device may be configured to split the signals captured by the one or more microphones of the first and second hearing devices into several frequency bands, FB, i.e. $FB_{1,1}$, $FB_{1,2}$, $FB_{1,3}$, . . . $FB_{1,N}$, for the first hearing device and $FB_{2,1}$, $FB_{2,2}$, $FB_{2,3}$, . . . $FB_{2,N}$ for the second hearing device. Thus, if $N_1>N_2$ for $FB_{1,1}$, $FB_{2,1}$ the hearing device system will use $FB_{2,1}$. Similarly, if $N_1<N_2$ for $FB_{1,2}$, $FB_{2,2}$ the hearing device system will use $FB_{1,2}$ and so forth for the remaining frequency bands.

Figure 2:
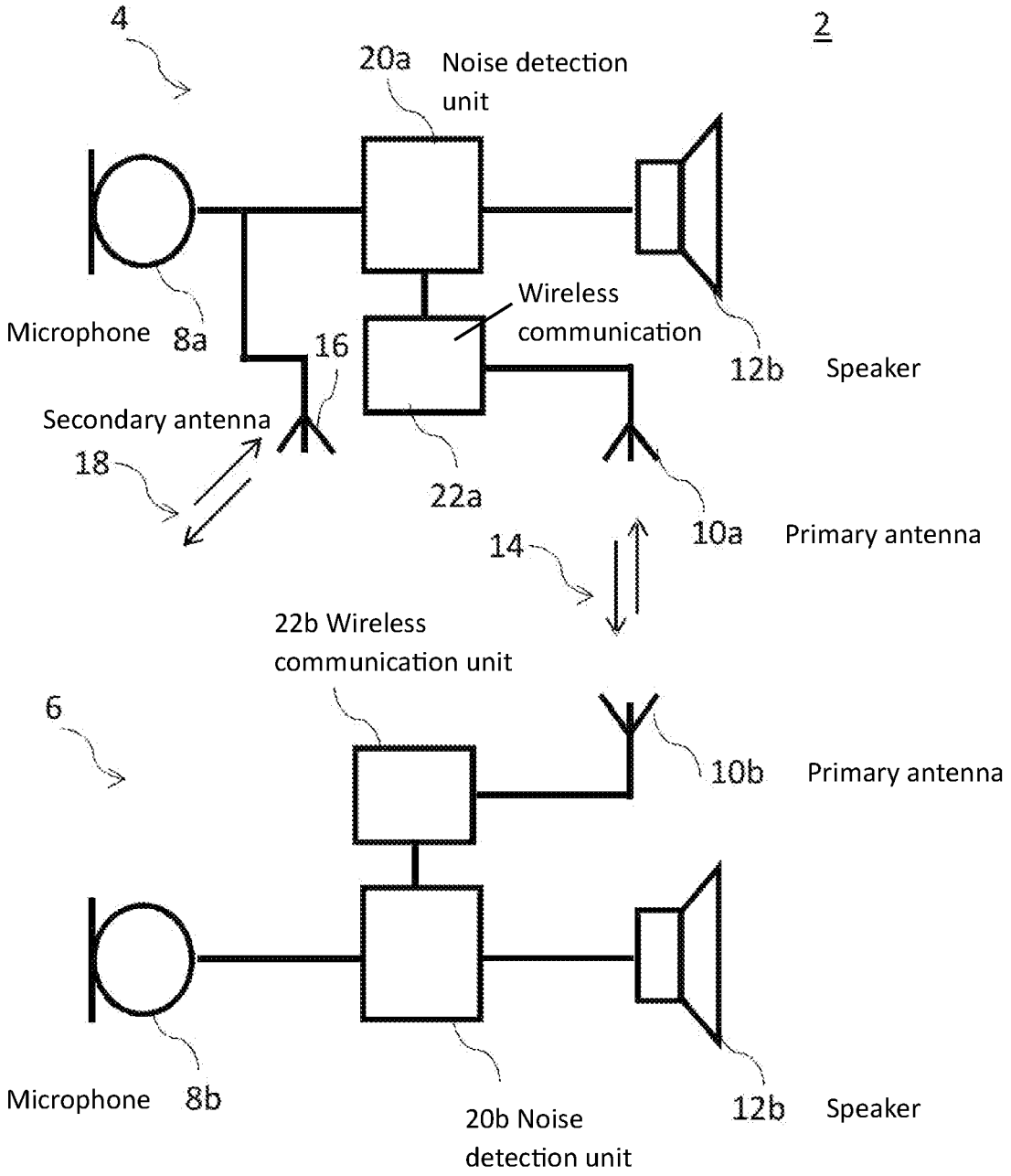
FIG. 2 schematically illustrates another example of a hearing device system comprising a first hearing device and a second hearing device.

FIG. 2 schematically illustrates another example of a hearing device system 2 comprising all the elements as described in connection to FIG. 1. The system of FIG. 2 further comprises noise detection units 20*a*, 20*b* comprised in the first hearing device 4 and the second hearing device 6, respectively. The noise detection units 20*a* and 20*b* may be configured to determine noise from the user's environment as well as to perform determination of $N_1$ and $N_2$. The hearing devices 4 and 6 may each comprise at least one wireless communication unit 22*a*, 22*b* configured for wireless communication and interconnected with the primary antennas 10*a*, 10*b*. The secondary antenna 16 may also be interconnected with a wireless communication unit (not shown). The secondary antenna 16 may be configured to receive and send signals to more than one external electronic device.

Figure 3:
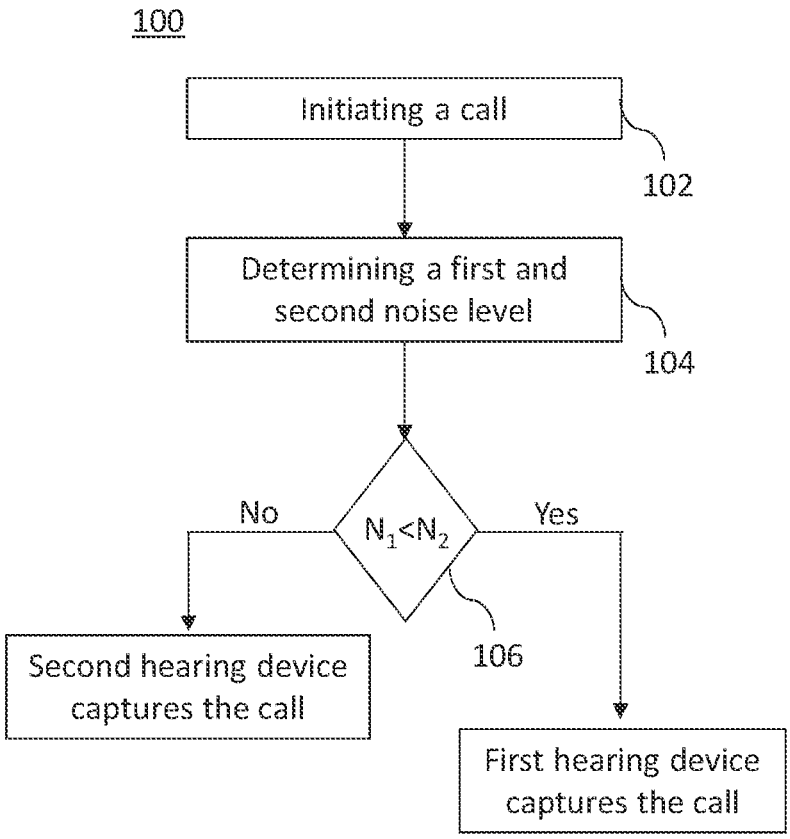
FIG. 3 schematically illustrates a flow chart of an example of a method in a hearing device system.

FIG. 3 schematically illustrates a flow chart of an example of a method 100 in a hearing device system. The hearing device system performing the method may be in accordance to the examples described in connection with FIG. 1 and FIG. 2. The first step of the method 100 is the step 102 of initiating the call between a user and a far-end caller. The method further comprises the step 104 of determining a first noise level, $N_1$, of sound received by the at least one microphone of the first hearing device and a second noise level, $N_2$, of sound received by the at least one microphone of the second hearing device. The determined noise levels are then compared in the step 106. When $N_1<N_2$, the at least one microphone of the first hearing device is selected to capture the user's voice for the call. When $N_1>N_2$, the at least one microphone of the second hearing device is selected to capture the user's voice for the call.

The call is initiated by establishing a wireless connection between the electronic device and at least one of the first and second hearing device which comprises the secondary antenna and typically further comprises a wireless communication unit. The electronic device may be seen as a master device controlling which hearing device to connect to.

Noise levels determination may be performed all times, regardless of whether the call is in progress or not. When the noise levels are measured and the call is initiated, the hearing device system, i.e. a processor unit of at least one hearing device, may compare the first and second noise levels determined by, e.g., a noise detection unit, and based on the comparison, make a decision on how to proceed with the call, i.e. which hearing device is to be used for continuing the call.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device system
4 first hearing device
6 second hearing device
8*a*, 8*b* microphone
10*a*, 10*b* primary antenna
12*a*, 12*b* speaker
14 first bidirectional wireless link
16 secondary antenna
18 second bidirectional link
20*a*, 20*b* noise detection unit
22*a*, 22*b* wireless communication unit
100 method in a hearing device system
102 initiating a call
104 determining noise levels
106 comparing noise levels

The invention claimed is:

1. A hearing device system comprising:

a first hearing device and a second hearing device configured to be worn at a first ear and a second ear, respectively, of a user, each of the first hearing device and the second hearing device comprising at least one microphone, a primary antenna, and a speaker, wherein the primary antennas of the respective first hearing device and the second hearing device are configured to establish a first bidirectional wireless link;

the first hearing device comprising a secondary antenna configured to establish a second bidirectional wireless link with an electronic device, the electronic device configured to establish a call between the user and a far-end person;

the hearing device system being configured to determine a first noise level, $N_1$, of sound received by the at least one microphone of the first hearing device, and a second noise level, $N_2$, of sound received by the at least one microphone of the second hearing device;

the hearing device system being further configured to operate in a call mode in which:

the first hearing device is configured to transmit a voice signal to the electronic device through the second bidirectional wireless link when $N_1<N_2$, the voice signal from the first hearing device being based on a voice of the user for the call captured by the at least one microphone of the first hearing device; and the second hearing device is configured to transmit, via the first bidirectional wireless link, a voice signal to the first hearing device for transmission to the electronic device via the second bidirectional wireless link when $N_1>N_2$, the voice signal from the second hearing device being based on the voice of the user for the call captured by the at least one microphone of the second hearing device.

2. The hearing device system according to claim 1, wherein each of the first and the second hearing devices comprises a noise detection unit, the noise detection units of the first and second hearing devices being configured to determine the first noise level $N_1$ and the second noise level $N_2$, respectively.

3. The hearing device system according to claim 2, wherein each of the noise detection units comprises an uncorrelated noise detector.

4. The hearing device system according to claim 1, wherein the first and second hearing devices are respective hearing aids configured to compensate for a hearing loss of the user.

5. The hearing device system according to claim 1, wherein the at least one microphone of the first hearing device is configured to capture the voice of the user upon a start of the call.

6. The hearing device system according to claim 1, wherein the at least one microphone of each of the first and second hearing devices comprises at least two microphones;

wherein each of the first and second hearing devices further comprises a beamformer;

wherein, when in the call mode, the hearing device system is configured to:

beamform signals from the at least two microphones of the first hearing device when $N_1<N_2$, and beamform signals from the at least two microphones of the second hearing device when $N_1>N_2$.

7. The hearing device system according to claim 1, wherein, when in the call mode, the hearing device system is configured to:

set a volume setting of the speaker of the second hearing device higher than a volume setting of the speaker of the first hearing device when $N_1<N_2$; and set the volume setting of the speaker of the second hearing device lower than the volume setting of the speaker of the first hearing device when $N_1>N_2$.

8. The hearing device system according to claim 1, wherein each of the first and second hearing devices comprises an active acoustic vent; and wherein, when in the call mode, the hearing device system is configured to:

open the acoustic vent of the first hearing device more than the acoustic vent of the second hearing device when $N_1<N_2$; and open the acoustic vent of the second hearing device more than the acoustic vent of the first hearing device when $N_1>N_2$.

9. The hearing device system according to claim 1, wherein the hearing device system is configured to analyze a frequency of noise in the sound received by the at least one microphone of the first hearing device, and to analyze a frequency of noise in the sound received by the at least one microphone of the second hearing device.

10. The hearing device system according to claim 1, wherein the hearing device system is configured to combine the voice signal associated with the first hearing device with the voice signal associated with the second hearing device, if the noise associated with the at least one microphone of the first hearing device comprises a frequency band different from the noise associated with the at least one microphone of the second hearing device.

11. A hearing device system comprising:

a first hearing device and a second hearing device configured to be worn at a first ear and a second ear, respectively, of a user, each of the first hearing device and the second hearing device comprising at least one microphone, a primary antenna, and a speaker;

wherein the hearing device system is configured to communicate with an electronic device, the electronic device configured to establish a call between the user and a far-end person;

the hearing device system being configured to determine a first noise level, $N_1$, of sound received by the at least one microphone of the first hearing device, and a second noise level, $N_2$, of sound received by the at least one microphone of the second hearing device;

wherein the hearing device system is configured to transmit a voice signal to the electronic device when in a call mode, the voice signal being based on a voice of the user captured by the at least one microphone of the first hearing device when $N_1<N_2$, or captured by the at least one microphone of the second hearing device when $N_1>N_2$.

12. The hearing device system according to claim 11, wherein the first hearing device of the hearing device system is configured to transmit the voice signal to the electronic device when $N_1<N_2$, the voice signal being based on the voice of the user captured by the at least one microphone of the first hearing device.

13. The hearing device system according to claim 11, wherein the second hearing device of the hearing device system is configured to transmit the voice signal to the electronic device when $N_1>N_2$, the voice signal being based on the voice of the user captured by the at least one microphone of the second hearing device.

14. The hearing device system according to claim 13, wherein the second hearing device is configured to transmit the voice signal to the electronic device indirectly via the first hearing device when $N_1>N_2$.

15. The hearing device system according to claim 14, wherein the second hearing device is configured to transmit the voice signal to the first hearing device via a communication link, and the first hearing device is configured to transmit the voice signal to the electronic device via another communication link.

16. The hearing device system according to claim 11, wherein the first and second hearing devices are respective hearing aids configured to compensate for a hearing loss of the user.

17. The hearing device system according to claim 11, wherein the at least one microphone of the first hearing device is configured to capture the voice of the user upon a start of the call.

18. The hearing device system according to claim 11, wherein the at least one microphone of each of the first and second hearing devices comprises at least two microphones;

wherein each of the first and second hearing devices further comprises a beamformer;

wherein, when in the call mode, the hearing device system is configured to:

beamform signals from the at least two microphones of the first hearing device when $N_1<N_2$, and beamform signals from the at least two microphones of the second hearing device when $N_1>N_2$.

19. The hearing device system according to claim 11, wherein, when in the call mode, the hearing device system is configured to:

set a volume setting of the speaker of the second hearing device higher than a volume setting of the speaker of the first hearing device when $N_1<N_2$; and set the volume setting of the speaker of the second hearing device lower than the volume setting of the speaker of the first hearing device when $N_1>N_2$.

20. The hearing device system according to claim 11, wherein each of the first and second hearing devices comprises an active acoustic vent; and wherein, when in the call mode, the hearing device system is configured to:

open the acoustic vent of the first hearing device more than the acoustic vent of the second hearing device when $N_1<N_2$; and open the acoustic vent of the second hearing device more than the acoustic vent of the first hearing device when $N_1>N_2$.

21. The hearing device system according to claim 11, wherein the hearing device system is configured to analyze a frequency of noise in the sound received by the at least one microphone of the first hearing device, and to analyze a frequency of noise in the sound received by the at least one microphone of the second hearing device.

22. A method performed by a hearing device system, the hearing device system comprising: a first hearing device and a second hearing device configured to be worn at a first ear and a second ear, respectively, of a user, each of the first hearing device and the second hearing device comprising at least one microphone, a primary antenna, and a speaker, wherein the hearing device system is configured to establish a call between the user and a far-end person, the method comprising:

determining a first noise level, $N_1$, of sound received by the at least one microphone of the first hearing device;

determining a second noise level, $N_2$, of sound received by the at least one microphone of the second hearing device;

when $N_1<N_2$, transmitting a signal from the first hearing device for reception by the electronic device, the signal from the first hearing device being based on the user's voice captured for the call by the at least one microphone of the first hearing device; and when $N_1>N_2$, transmitting a signal from the second hearing device for reception by the electronic device, the signal from the second hearing device being based on the user's voice captured for the call by the at least one microphone of the second hearing device.

* * * * *